US009470165B2

(12) United States Patent
Conrad

(10) Patent No.: US 9,470,165 B2
(45) Date of Patent: Oct. 18, 2016

(54) FILTER REGENERATION SYSTEM AND METHOD

(75) Inventor: Larry J. Conrad, Smicksburg, PA (US)

(73) Assignee: Brookville Equipment Corporation, Brookville, PA (US)

( * ) Notice: Subject to any disclaimer, the term of this patent is extended or adjusted under 35 U.S.C. 154(b) by 1414 days.

(21) Appl. No.: 12/774,327

(22) Filed: May 5, 2010

(65) Prior Publication Data

US 2010/0281852 A1 Nov. 11, 2010

Related U.S. Application Data

(60) Provisional application No. 61/175,551, filed on May 5, 2009.

(51) Int. Cl.

| | |
|---|---|
| ***F01N 3/023*** | (2006.01) |
| ***F01N 3/20*** | (2006.01) |
| ***F01N 9/00*** | (2006.01) |
| ***F02D 41/02*** | (2006.01) |
| *F01N 3/035* | (2006.01) |

(52) U.S. Cl.

CPC ..... *F02D 41/029* (2013.01); *F01N 3/035* (2013.01); *F02D 2041/026* (2013.01)

(58) Field of Classification Search

USPC ..... 60/295, 297, 274

See application file for complete search history.

(56) References Cited

U.S. PATENT DOCUMENTS

| | | | | |
|---|---|---|---|---|
| 6,865,883 | B2 * | 3/2005 | Gomulka | 60/295 |
| 7,461,504 | B2 | 12/2008 | Warner et al. | |
| 2006/0130459 | A1 | 6/2006 | Warner et al. | |
| 2008/0163610 | A1 | 7/2008 | Baird et al. | |

* cited by examiner

*Primary Examiner* — Kenneth Bomberg
*Assistant Examiner* — Brandon Lee
(74) *Attorney, Agent, or Firm* — The Webb Law Firm

(57) ABSTRACT

A filter regeneration system for an internal combustion engine operable at an engine speed and having: a gas exhaust system for fluidly expelling exhaust gas at an exhaust gas temperature; and at least one filter arrangement in fluid communication with the gas exhaust system and configured to capture particulate in the exhaust gas. The regeneration system includes: a load generating arrangement in operable communication with the internal combustion engine and configured to modify the mechanical load on the internal combustion engine, thereby changing the exhaust gas temperature; and at least one controller in electrical communication with at least a portion of the load generating arrangement and configured to control at least one operating parameter of the load generating arrangement. A method of regenerating a filter arrangement is also disclosed.

2 Claims, 2 Drawing Sheets

FILTER REGENERATION SYSTEM AND METHOD

CROSS REFERENCE TO RELATED APPLICATIONS

This application claims the benefit of priority to U.S. Provisional Patent Application Ser. No. 61/175,551, filed May 5, 2009, which is incorporated herein by reference in its entirety.

FIELD OF THE INVENTION

The present invention relates generally to methods, systems and arrangements for controlling exhaust gas temperatures in an internal combustion engine, and in particular to a filter regeneration system and method for use in facilitating regeneration of filter arrangement in fluid communication with an exhaust gas system of an internal combustion engine.

DESCRIPTION OF THE RELATED ART

A filter arrangement is often used in connection with or as part of an internal combustion engine. The internal combustion engine is operable at an engine speed and includes an exhaust gas system for fluidly expelling exhaust gas at an exhaust gas temperature. This filter arrangement is in fluid communication with the exhaust gas temperature and serves the primary purpose of capturing particulate matter in the exhaust gas. Accordingly, such a filter arrangement acts as a pollution control device that ensures that this undesirable particulate material is not dispersed into the ambient air.

In certain known internal combustion engines and associated systems that use such a filter arrangement, it is often desirable to oxidize or burn the captured particulate matter in a process commonly referred to as "regeneration." This process is beneficial in that the reduced particulate matter in the filter arrangement reduces the restriction of the filter arrangement on the flow of the exhaust gas, thereby increasing the fuel economy of the engine. In addition, this regeneration process is dependent upon temperatures at the filter arrangement, which may be influenced directly or indirectly by the temperature of the exhaust gas.

One known method and system for implementing a regeneration process is shown and described in U.S. Pat. No. 7,461,504 to Warner et al. In this process, exhaust valve timing and/or the additional fueling of normally-operating cylinders is utilized to increase exhaust gas temperatures. For example, the four-stroke cycle and process claimed in the '504 patent includes: opening and closing the intake valve to induct air during an intake stroke; opening and closing the exhaust valve near the end of the compression stroke; opening and closing the intake valve to induct additional air during an expansion stroke; and delaying opening of the exhaust valve in an exhaust stroke. Therefore, the actual operative process of the cylinders must be modified, or alternatively, some fuel additive must be included, in order to successfully implement the system and method of the '504 patent.

Accordingly, it is desirable to provide methods and systems for facilitating the regeneration of a filter arrangement, such as a particulate filter apparatus, in order to maintain or increase the fuel economy of the engine. It is further desirable to achieve this regeneration without the use of fuel additives or the modification of the valve timing or other similar normal operational parameters of the engine.

SUMMARY OF THE INVENTION

It is, therefore, one object of the present invention to provide a filter regeneration system and method that overcomes at least some of the deficiencies of the prior art filter regeneration systems and methods. In some preferred and non-limiting embodiments, the present invention provides a filter regeneration system and method that does not require any fuel additives or modifications to the valve timing or other similar normal operational parameters of an internal combustion engine. In other preferred and non-limiting embodiments, the present invention provides a filter regeneration system and method that permits control of the exhaust gas temperature, and, thus, control of the regeneration process of the filter arrangement.

Accordingly, and in one preferred and non-limiting embodiment, the present invention is directed to a filter regeneration system for an internal combustion engine operable at an engine speed and having: a gas exhaust system for fluidly expelling exhaust gas at an exhaust gas temperature; and at least one filter arrangement in fluid communication with the gas exhaust system and configured to capture particulate matter in the exhaust gas. The regeneration system includes: a load generating arrangement in operable communication with the internal combustion engine and configured to modify the mechanical load on the internal combustion engine, thereby changing the exhaust gas temperature; and at least one controller in electrical communication with at least a portion of the load generating arrangement and configured to control at least one operating parameter of the load generating arrangement.

In another preferred and non-limiting embodiment, the present invention is directed to a method of regenerating a filter material in a filter arrangement in an internal combustion engine operable at an engine speed and having: a gas exhaust system for fluidly expelling exhaust gas at an exhaust gas temperature, the filter arrangement in fluid communication with the gas exhaust system and configured to capture particulate in the exhaust gas. This method includes: modifying the mechanical load on the internal combustion engine, thereby changing the exhaust gas temperature; supplying the exhaust gas to the filter arrangement; contacting the exhaust gas with at least a portion of the filter arrangement; and controlling the exhaust gas temperature.

In a still further preferred and non-limiting embodiment, the present invention is directed to a filter regeneration system in an internal combustion engine operable at an engine speed and having: a gas exhaust system for fluidly expelling exhaust gas at an exhaust gas temperature; and at least one filter arrangement in fluid communication with the gas exhaust system and configured to capture particulate matter in the exhaust gas. This regeneration system includes: a load generating arrangement in operable communication with the internal combustion engine and configured to modify the mechanical load on the internal combustion engine, thereby changing the exhaust gas temperature; and at least one controller in electrical communication with at least a portion of the load generating arrangement and configured to control at least one operating parameter of the load generating arrangement.

These and other features and characteristics of the present invention, as well as the methods of operation and functions of the related elements of structures and the combination of parts and economies of manufacture, will become more apparent upon consideration of the following description and the appended claims with reference to the accompanying drawings, all of which form a part of this specification, wherein like reference numerals designate corresponding parts in the various figures. It is to be expressly understood, however, that the drawings are for the purpose of illustration and description only and are not intended as a definition of the limits of the invention. As used in the specification and the claims, the singular form of "a", "an", and "the" include plural referents unless the context clearly dictates otherwise.

DETAILED DESCRIPTION OF THE PREFERRED EMBODIMENTS

Figure 1:
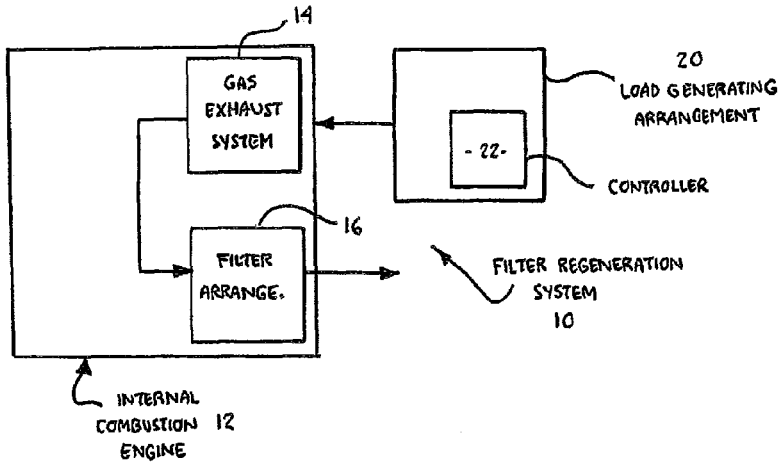
FIG. 1 is a schematic view of one embodiment of a filter regeneration system according to the principles of the present invention.

For purposes of the description hereinafter, the terms "upper", "lower", "right", "left", "vertical", "horizontal", "top", "bottom", "lateral", "longitudinal" and derivatives thereof shall relate to the invention as it is oriented in the drawing figures. However, it is to be understood that the invention may assume various alternative variations and step sequences, except where expressly specified to the contrary. It is also to be understood that the specific devices and processes illustrated in the attached drawings, and described in the following specification, are simply exemplary embodiments of the invention. Hence, specific dimensions and other physical characteristics related to the embodiments disclosed herein are not to be considered as limiting.

It is to be understood that the invention may assume various alternative variations and step sequences, except where expressly specified to the contrary. It is also to be understood that the specific devices and processes illustrated in the attached drawings, and described in the following specification, are simply exemplary embodiments of the invention.

The present invention is related to a filter regeneration system 10, as well as a method of regenerating a filter material in a filter arrangement, as illustrated in various exemplary and non-limiting embodiments in FIGS. 1-6. The presently-invented system 10 can be used in connection with a variety of systems and arrangements that require filter and/or filter material regeneration, such as in a power train system or similar engine used in connection with driving a vehicle. For example, the system 10 may be used in connection with an internal combustion engine 12, which is used to drive a vehicle, a truck, an automobile, construction equipment, a marine vessel, a generator, a locomotive, a rail car, Diesel Multiple Units (DMUs), etc.

With reference to FIG. 1, and in one preferred and non-limiting embodiment, the filter regeneration system 10 of the present invention is used in connection with an internal combustion engine 12, which is operable at a specified engine speed. Further, this internal combustion engine 12 includes, is integrated with, or is otherwise in operable communication with a gas exhaust system 14 for fluidly expelling exhaust gas at an exhaust gas temperature. In addition, the internal combustion engine 12 includes, is integral with, or is in operable communication with at least one filter arrangement 16, which is in fluid communication with the gas exhaust system 14. This filter arrangement 16 is used to capture particulate matter 18 in the exhaust gas produced by the internal combustion engine 12 and associated process.

In this embodiment, the filter regeneration system 10 includes a load generating arrangement 20 integral with or in operable communication with the internal combustion engine 12. This load generating arrangement 20 is used to modify the mechanical load on the internal combustion engine 12, thereby changing the temperature of the exhaust gas. In addition, the system 10 includes at least one controller 22, which is in electrical communication with at least a portion of the load generating arrangement 20, e.g., one or more components of this arrangement 20, and this controller 22 is configured, adapted or programmed to control at least one operating parameter of the load generating arrangement 20.

In one preferred and non-limiting embodiment, the controller 22 is in electrical communication with a portion or component of the internal combustion engine 12, such that it can be used to control one or more operating parameters of the internal combustion engine 12. For example, the controller 22 may be used to monitor and/or control the engine speed of the internal combustion engine 12.

The controller 22 may also be used to monitor and determine the mechanical load on the internal combustion engine 12 by monitoring the operating parameters in the engine 12 and/or the operating parameters of the load generating arrangement 20. For example, the controller 22 may be able to determine the engine loading as a function of the desired exhaust gas temperature, with the recognition that the exhaust gas temperature is directly proportional to the engine load. In this manner, the controller 22 may be used to adjust the engine load to emit exhaust gas at the desired exhaust gas temperature by increasing or decreasing the load on the engine 12. Accordingly, the temperature of the emitted exhaust gases can be controlled and maintained within a predefined temperature range.

By determining a desired exhaust gas temperature, i.e., a temperature wherein the particulate matter 18 is burned and/or at least partially eliminated, one or more portions or components of the filter arrangement 16 may be regenerated. For example, this desired exhaust gas temperature may be greater than the exhaust gas temperature of the exhaust gas emitted from the internal combustion engine 12 in an unloaded state. Further, the engine 12, or at least one component thereof, may be controlled to emit gases at the desired exhaust gas temperature by controlling the load of the engine at a constant speed.

Further, in one preferred and non-limiting embodiment, the regeneration of the filter arrangement 16 occurs when the engine 12 is operating at or near an idle speed, where the at least one controller 22 controls at least one component of the engine 12 to selectively control the emitted exhaust gas temperature at or above the desired exhaust gas temperature by increasing the engine idle speed, and monitoring the increased load at each speed. By using such an iterative process, the system 10 of the present invention can be used to effectively monitor and control the mechanical load on the engine 12 in order to produce the desired exhaust gas temperatures to aid in the regeneration of the filter arrangement 16 (through the burning or elimination of the particulate matter 18 captured in the filter arrangement 16). In addition, the controller 22 (again, which may be the above-referenced controller 22 or some other controller that is in operable communication with the engine 12) may be used to control not only engine speed but also engine loading through a power controller or some other separate control device.

Figure 2:
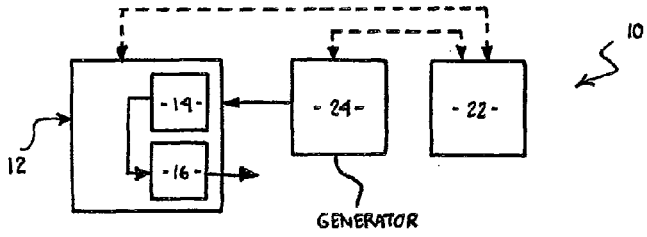
FIG. 2 is a schematic view of another embodiment of a filter regeneration system according to the principles of the present invention.

In one preferred and non-limiting embodiment, and as illustrated in schematic form in FIG. 2, the load generating arrangement 20 may be in the form of or include at least one generator 24, which is operable at a specified electrical load and torque and used to produce current. Further, this generator 24 is in operable communication with and driven by the internal combustion engine 12, which thereby increases the load on the internal combustion engine 12. The controller 22 may be used to control the electrical load and/or the torque of the generator 24 in order to increase or decrease the mechanical load on the internal combustion engine 12, thereby modifying the temperature of the exhaust gases. Further, in this embodiment, the controller 22 is used to monitor and/or control various operating parameters of both the generator 24 and the internal combustion engine 12. For example, the engine speed may be set with the controller 22 (or a separate engine controller) and the mechanical load on the engine adjusted through an adjustment of the load on the generator 24.

Figure 3:
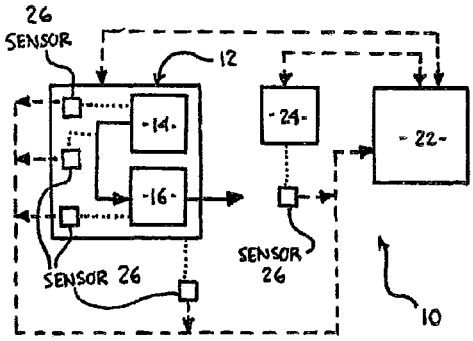
FIG. 3 is a schematic view of a further embodiment of a filter regeneration system according to the principles of the present invention.

In a further preferred and non-limiting embodiment, the system 10 may include at least one sensor 26 in communication with the controller 22 and configured, adapted, or programmed to sense at least one parameter of a portion or component of the internal combustion engine 12, the load generating arrangement 20, the gas exhaust system 14, the filter arrangement 16, etc. Still further, the sensors 26 may be used to monitor and/or sense the engine speed, the exhaust gas flow and/or the intake air flow, the exhaust gas temperature, the filter arrangement temperature, the torque of at least one component of the load generating arrangement 20, the electrical load of at least one component of the load generating arrangement 20, exhaust back pressure, pressure differential across the filter arrangement 16, etc. Such an embodiment is illustrated in FIG. 3. By using the data and information provided and obtained by these sensors 26, the operating parameters of the internal combustion engine 12, the gas exhaust system 14, the filter arrangement 16, and/or the load generating arrangement 20 may be controlled to obtain the proper mechanical load on the engine and/or the desired exhaust gas temperature. For example, by monitoring the pressure differential across the filter arrangement 16 (such as the filter media), the initiation, monitoring, and/or termination of the regeneration process can be controlled.

Figure 4:
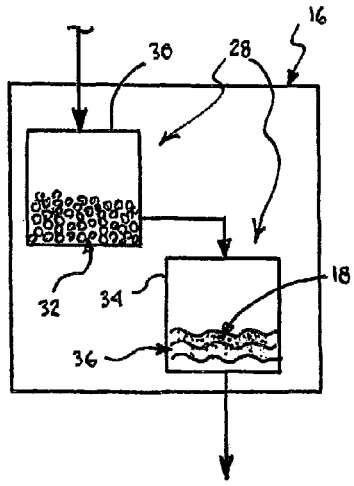
FIG. 4 is a schematic view of a filter arrangement for use in connection with a filter regeneration system according to the principles of the present invention.

With respect to the filter arrangement 16, and in one preferred and non-limiting embodiment illustrated in FIG. 4, this filter arrangement 16 may include one or more canisters through which the exhaust gas flows and particulate matter 18 is at least partially captured. For example, the filter arrangement 16 may include an oxidation catalyst canister 30, which includes an oxidation catalyst material 32 therein, as well as a particulate filter canister 34, which includes a filtering material 36 therein.

In this embodiment, the oxidation catalyst canister 30, which includes the oxidation catalyst material 32 therein, at least partially oxidizes hydrocarbons and/or carbon monoxide present in the exhaust gas. Further, in this embodiment, the particulate filter canister 34 (having the filtering material 36 therein) is used to at least partially capture the particulate matter 18, which may include carbon particulates, oil particulates, ash particulates, etc. At least a portion of this captured particulate matter 18 is oxidized at a specified exhaust gas temperature which is produced through the use of the presently-invented system 10.

The present invention is further directed to a method of regenerating the filtering material in the filter arrangement 16 by: modifying the mechanical load on the internal combustion engine 12, thereby changing the exhaust gas temperature; supplying the exhaust gas to the filter arrangement 16; contacting the exhaust gas with at least a portion of the filter arrangement 16; and controlling the exhaust gas temperature. The modification of the exhaust gas temperature through the modification of the mechanical load on the internal combustion engine 12 can be effected or implemented as set forth in detail hereinabove.

It is further envisioned that the filter regeneration system 10 may include one or more components that are installed or manufactured concurrently with the internal combustion engine 12. Accordingly, all of the components of the system 10, which are operable to implement the above-described method, can be installed and appropriately integrated with the internal combustion engine 12 at the factory. However, it is further envisioned that one or more of the components of the filter regeneration system 10 may be installed and integrated (retrofitted) with the internal combustion engine 12 after the engine 12 and/or vehicle is produced or manufactured. Therefore, the system 10 is equally useful in connection with a post-manufacturing process, and may be retroactively integrated with the engine 12. Since, in one embodiment, the load generating arrangement 20 includes at least one generator 24, this generator may be installed or placed in operable communication with the internal combustion engine 12 at any point in the manufacturing process or thereafter.

Figure 5:
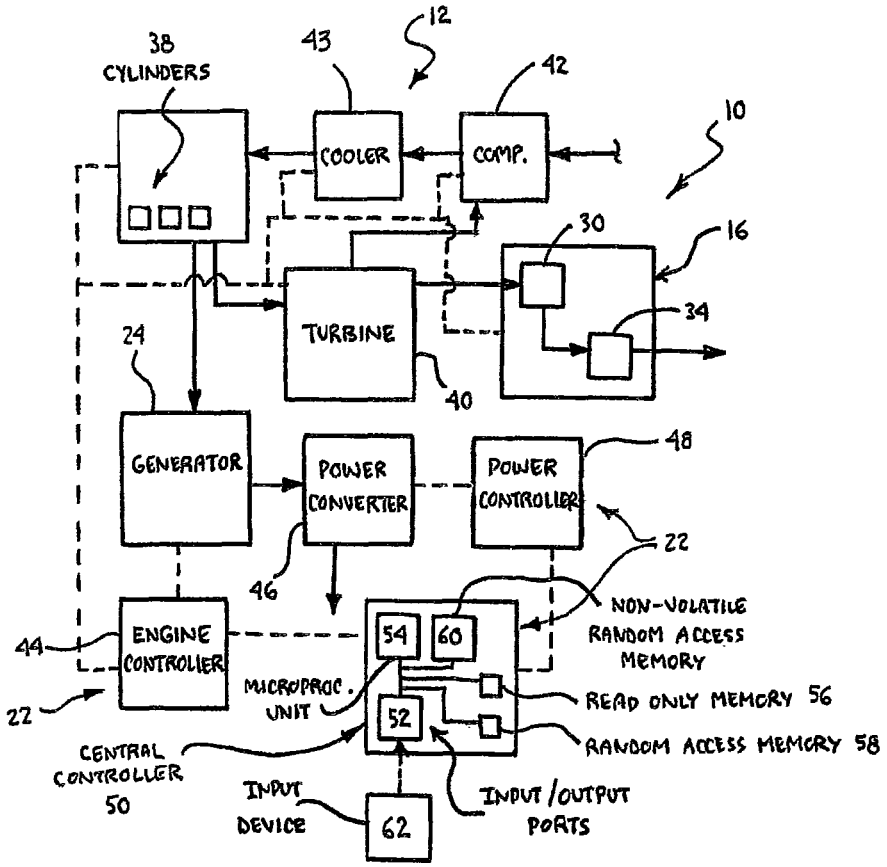
FIG. 5 is a schematic view of a still further embodiment of a filter regeneration system according to the principles of the present invention.

Another preferred and non-limiting embodiment of the present invention is illustrated in schematic form in FIG. 5. With reference to this embodiment, the filter regeneration system 10 is used in connection with an internal combustion driven system where fuels, such as gasoline and diesel fuels, are burned in a combustion process to provide power, such as with a spark or in a compression ignition engine 12. Accordingly, the engine 12 may be a diesel engine that includes a number of cylinders 38 into which fuel and air are injected for ignition, which is a well-known process. The engine 12 may be a multi-cylinder compression ignition internal combustion engine, such as a 4-, 6-, 8-, 12-, 16-, or 20-cylinder diesel engine. However, as discussed above, the present invention is not limited to any particular type of engine or operating fuel.

In this embodiment, the exhaust gas generated by the engine 12 during the combustion process is emitted through the gas exhaust system 14, and the gas exhaust system 14 includes an exhaust manifold and passageways to deliver the emitted gases to the filter arrangement 16. It is also envisioned that the gas exhaust system 14 may include or be in operable communication with a turbo charger located adjacent the exhaust manifold for compressing fresh air delivery into the engine 12. For example, this turbo charger may include a turbine 40, a compressor 42, and a cooler 43 such that the turbo charger may be a variable geometry turbo charger, a turbo compound power turbine, etc. Of course, and as discussed above, the present invention is not limited to any particular gas exhaust system 14.

With reference to the filter arrangement 16 in this embodiment, both an oxidation catalyst canister 30 and a particulate filter canister 34 are utilized. These canisters 30, 34 may be separate components joined together with a clamp or other fastener, such that the canisters 30, 34 can be separated for servicing and other maintenance operations. Alternatively, the oxidation catalyst material 32 may be incorporated with or into the filtering material 36 in the form of catalyst beads, catalyst coating, or the like.

Any number of arrangements of the filter arrangement 16 is envisioned. For example, the filter arrangement 16 may include only the particulate filter canister 34 and/or filtering material 36, and not include the oxidation catalyst canister 30 and associated oxidation catalyst material 32. Further, the particulate filter canister 34 or similar component can be located in other portions of the gas exhaust system 14, such as upstream from the turbine 40.

With reference to the embodiment of FIG. 5, the oxidation catalyst canister 30 is commonly referred to as a diesel oxidation catalyst when used in connection with a diesel engine, and as discussed above, this oxidation catalyst material 32 oxidizes hydrocarbons and carbon monoxide, which also leads to an increased temperature in the particulate filter canister 34. Further, this particular filter canister 34 and/or the associated filtering material 36 may be used to capture harmful carbonaceous particles that are included in the exhaust gas, and this particulate matter 18 will be captured and stored until temperatures in the particulate filter canister 34 favor or are amenable to oxidation of this captured particulate matter 18, where the resulting gas is discharged to the atmosphere.

In another embodiment, it is envisioned that the oxidation catalyst canister 30 and the particulate filter canister 34 may include a variety of inlets and outlets having a defined cross-sectional area, with expansive portions therebetween to store the oxidation catalyst material 32 and the filtering material 36 (or media). However, it is further envisioned that these canisters 28, 30, 34 may include any number of configurations and arrangements for oxidizing emissions and capturing particulate matter 18.

In another embodiment, multiple controllers 22 are included in the system 10 and constitute an electronic control module. For example, in the embodiment of FIG. 5, the various operations and parameters of the engine 12 are controlled through an engine controller 44, while the various operations and parameters of the generator 24 and/or a power converter 46 (in operable communication with the generator 24) may be controlled through a power controller 48. Further, in this embodiment, both the engine controller 44 and the power controller 48 are in electrical communication with and controllable through a central controller 50. Any one of these controllers 44, 48, 50 may be directly or indirectly (and wired or wirelessly) in communication with the various systems and subsystems and/or components and subcomponents in the filter regeneration system 10 and/or internal combustion engine 12.

Further, as illustrated in FIG. 5, any of the controllers 22, e.g., the central controller 50, may be in electrical communication, directly or indirectly, with the sensors 26 and the system 10 and engine 12. In particular, these sensors 26 are in communication with the central controller 50 through various input/output ports 52. Further, the central controller 50 may include a microprocessor unit 54, which is in communication with various computer-readable storage media via a data and control bus.

As is known in the art, the computer-readable storage media may include any number of known devices that function as read only memory 56, random access memory 58, and non-volatile random access memory 60. In addition, a data, diagnostics, and programming input and/or output device 62 may also be connected to and used in connection with the central controller 50 (or any of the aforementioned controllers 22) via a plug to exchange information and data therebetween. Further, this input and output device 62 can be used to change values within the computer-readable storage media, such as configuration settings, calibration variables, gas exhaust system 14 controls, etc.

In operation, and in this preferred and non-limiting embodiment illustrated in FIG. 5, the central controller 50 receives signals from various engine 12 and/or vehicle sensors 26 and executes control logic embedded in hardware and/or software to control the system 10 and/or the internal combustion engine 12. Further, the computer-readable storage media may, for example, include instructions stored thereon that are executable by the central controller 50 to perform methods of controlling all features and subsystems in the system 10 and internal combustion engine 12 (and/or any portion of the vehicle). For example, these programmed instructions may be executed by the central controller 50 (or any of the controllers 22) in the microprocessor unit 54 to control the various systems and subsystems, and components and subcomponents of the engine 12 and/or vehicle, through the input/output ports 52. Of course, any number of sensors 26 and other functional devices may be associated with the system 10 for monitoring and controlling the operation thereof.

In a further non-limiting embodiment, as discussed above, the engine 12 may be controlled in order to specifically emit exhaust gases at the desired exhaust gas temperature to facilitate regeneration of the filter arrangement 16. For example, the engine 12 may be controlled and operated as a function of a difference between the desired exhaust gas temperature and the current exhaust gas temperature, so as to raise the exhaust gas temperatures to the desired exhaust gas temperatures for specific use in facilitating regeneration of the filter arrangement 16. Further, the engine 12, when used as part of the filter regeneration system 10, is capable of maintaining this increased exhaust gas temperature to the required level and required amount of time to regenerate the filter arrangement 16 to a specified level. As discussed, the control of the system 10 may occur through software and/or hardware included or embedded on the central controller 50, the engine controller 44, the power controller 48, or any of the above-discussed controllers 22. However, this control feature may be distributed in order to efficiently and effectively implement the presently-invented method.

Figure 6:
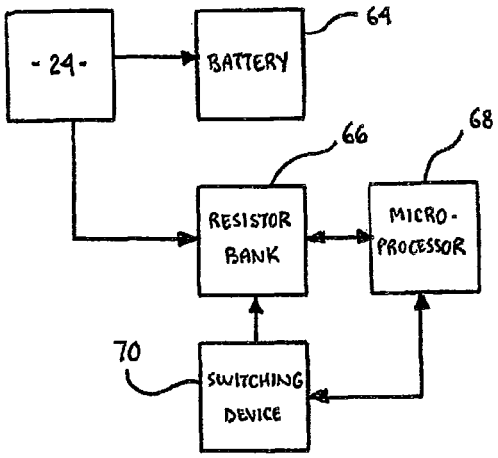
FIG. 6 is a schematic view of another embodiment of a portion of a filter regeneration system according to the principles of the present invention.

As illustrated in FIG. 6, and in one preferred and non-limiting embodiment, the generator 24 can be used to supply electricity or power to other components of the internal combustion engine 12 and/or vehicle, e.g., the electrical system of the vehicle. Further, this generator 24 may be used to supply power and electricity to a battery 64 for charging or storage thereof. Again, any number of operations can be used in connection with the filter regeneration system 10, which may serve the dual purpose of raising the exhaust gas temperatures to regenerate the filter arrangement 16 and supply electricity or power to any of the components or subcomponents of the vehicle.

Still further, if this excess electricity cannot be beneficially used in the filter regeneration system 10 or the internal combustion engine 12, it may be dissipated through the use of a resistor bank 66. Such a resistor bank 66 may be controlled by a microprocessor 68 (or any of the above-discussed controllers). In particular, the microprocessor 68 is in electrical communication with a switching device 70, which provides for the controlled dissipation of power. Various parameters can be monitored in connection with the resistor bank 66, including resistor voltage and amperage.

In this manner, the present invention provides a filter regeneration system 10 and method for use in controlling and/or modifying the temperatures of exhaust gas emitted from an internal combustion engine 12 to facilitate regeneration of a filter arrangement 16. As discussed, the temperature of the exhaust gas from the internal combustion engine 12 may be modified by changing the mechanical load on the internal combustion engine 12 through the use of the load generating arrangement 20, e.g., the generator 24.

Although the invention has been described in detail for the purpose of illustration based on what is currently considered to be the most practical and preferred embodiments, it is to be understood that such detail is solely for that purpose and that the invention is not limited to the disclosed embodiments, but, on the contrary, is intended to cover modifications and equivalent arrangements that are within the spirit and scope of the appended claims. For example, it is to be understood that the present invention contemplates that, to the extent possible, one or more features of any embodiment can be combined with one or more features of any other embodiment.

What is claimed is:

1. In an internal combustion engine including a gas exhaust system for fluidly expelling exhaust gas at an exhaust gas temperature and at least one filter arrangement in fluid communication with the gas exhaust system for capturing particulate matter in the exhaust gas and a regeneration system, said regeneration system comprising:

a load generating arrangement operative for modifying a mechanical load on the internal combustion engine, thereby changing the exhaust gas temperature; and at least one controller operative for controlling at least one operating parameter of the load generating arrangement to set the temperature of the exhaust gas temperature at a desired temperature.

2. The regeneration system of claim 1, wherein the internal combustion engine is configured to drive one of the following: a vehicle, a truck, an automobile, construction equipment, a marine vessel, a generator, a locomotive, a rail car, diesel multiple units, or any combination thereof.

* * * * *